United States Patent [19]

Wisebaker

[11] 4,317,354

[45] Mar. 2, 1982

[54] BLANK REJECTOR FOR FORGING MACHINE

[75] Inventor: Dale A. Wisebaker, Tiffin, Ohio

[73] Assignee: The National Machinery Company, Tiffin, Ohio

[21] Appl. No.: 110,948

[22] Filed: Jan. 10, 1980

[51] Int. Cl.[3] ..... B21D 45/00

[52] U.S. Cl. ..... 72/339; 72/10; 72/14; 72/361; 83/79

[58] Field of Search ..... 72/10, 14, 34, 339, 72/361; 83/79

[56] References Cited

U.S. PATENT DOCUMENTS

| | | | |
|---|---|---|---|
| 2,542,864 | 2/1951 | Friedman | 10/76 R |
| 2,689,358 | 9/1954 | Deloe | 10/12 T |
| 3,264,853 | 8/1966 | Huber | 72/10 |
| 3,373,584 | 3/1968 | Rundt et al. | 72/10 |
| 3,831,411 | 8/1974 | Sakai et al. | 72/10 |
| 3,972,211 | 8/1976 | Linthicum et al. | 72/14 |
| 4,084,278 | 4/1978 | Allebach et al. | 72/405 |
| 4,202,191 | 5/1980 | Skinner | 72/10 |

*Primary Examiner*—Daniel C. Crane

*Attorney, Agent, or Firm*—Pearne, Gordon, Sessions, McCoy & Granger

[57] ABSTRACT

A forging machine is disclosed which is provided with means to determine when an undersized or short blank is produced by the shear and to provide for the automatic rejection of such blank. Such short blanks can occur if the stock feed into the shear is insufficient. The illustrated embodiment includes a shear for progressively cutting blanks from the forward end of a piece of stock in which the shear is provided with a load cell in the stock gauge to determine when improper feeding has occurred. Such load cell includes a strain gauge and the signal produced by the strain gauge actuates an overstroke ejection which pushes the blank from the first working station through the transfer fingers so that it does not transfer to a subsequent work station. The overstroke is provided by a piston and cylinder actuator mounted on the ejector lever which operates in response to a signal that the blank in the work station is of improper size.

13 Claims, 6 Drawing Figures

BLANK REJECTOR FOR FORGING MACHINE

BACKGROUND OF THE INVENTION

This invention relates generally to progressive forging machines or the like and, more particularly, to a novel and improved system for rejecting improper size workpieces.

PRIOR ART

Various types of automatic forging machines include shears which cut workpieces or blanks of measured length from lengths of elongated stock and thereafter transfer the workpiece to one or more work stations at which the workpiece is formed to the required shape. If for some reason the shear produces a workpiece of improper size, such as a short workpiece, it is desirable to provide means to detect the improperly-sized workpiece or blank and to automatically reject it.

In U.S. Pat. No. 3,972,211, and in the copending application Ser. No. 063,763, filed Aug. 6, 1979 (both assigned to the assignee of the present invention), now U.S. Pat. No. 4,283,974, machines are disclosed for automatically rejecting workpieces of improper size. Both of these machines provide a transfer mechanism in which the workpiece is gripped for transfer and wherein power means are provided to open the gripping structure so that the improperly sized workpiece is not gripped and is dropped out of the machine. Such machines, however, require that the gripper be capable of being mechanically opened to allow the workpiece to be dropped.

SUMMARY OF THE INVENTION

The present invention provides for the automatic rejection of improperly sized workpieces or blanks without requiring the use of a transfer gripper which can be mechanically opened to release the workpiece that is being rejected. Examples of such transfers are illustrated in U.S. Pat. Nos. 2,542,864; 2,689,358; and 4,084,278. All of such patents disclose transfer systems in which the gripper fingers are spring-loaded and in which no mechanism is provided for opening the fingers for the rejection of the workpiece. The mechanism of such gripper transfer is preferred when possible because of the simplicity of the structure. With the illustrated embodiment of this invention, means are provided to extend the stroke of the knockout or ejector when workpiece rejection is required to eject the workpiece through and clear of the fingers so that it falls out of the machine and is not transferred to a subsequent station.

In the illustrated embodiment, the overstroke of the knockout is provided by an air cylinder mounted on the knockout lever which operates when pressurized to extend the knockout pin beyond its usual stroke when workpiece rejection is required. A sensor which produces the rejection signal, in the illustrated embodiment, is a load sensing strain gauge located in the stock gauge of the shear. If a full feed stroke does not occur for any reason, the stock gauge is not properly engaged, and the strain gauge produces a signal which indicates that, in the next operation of the shear, a short workpiece or blank will be produced. Such signal causes the air cylinder to be pressurized during the next knockout operation to eject the short workpiece from the first work station through the associated transfer gripper fingers to allow the short workpiece to drop out of the machine.

Although in the present invention a system is illustrated in which sensing is provided in the shear and rejection of the workpiece occurs from the first work station, it is in accordance with the broader aspects of this invention to provide the sensing and rejection at any desired work station.

These and other aspects of the invention are described more fully in the following specification.

DETAILED DESCRIPTION OF THE DRAWINGS

Figure 1:
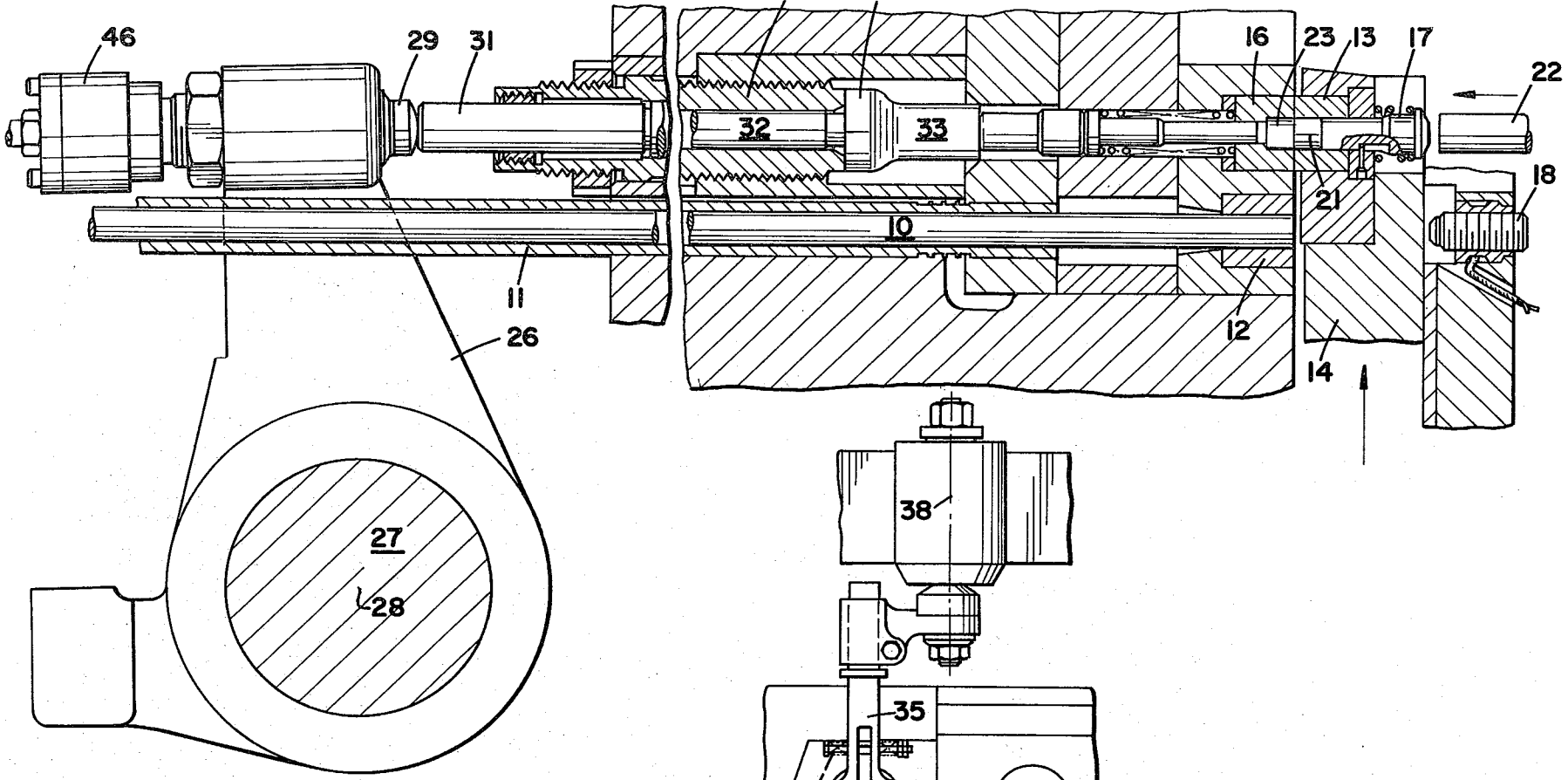
FIG. 1 is a fragmentary, longitudinal section of a forging machine incorporating this invention through the shear station and the first work station and illustrating the parts with the knockout in the retracted position and a workpiece immediately prior to being inserted into the work station.
Figure 2:
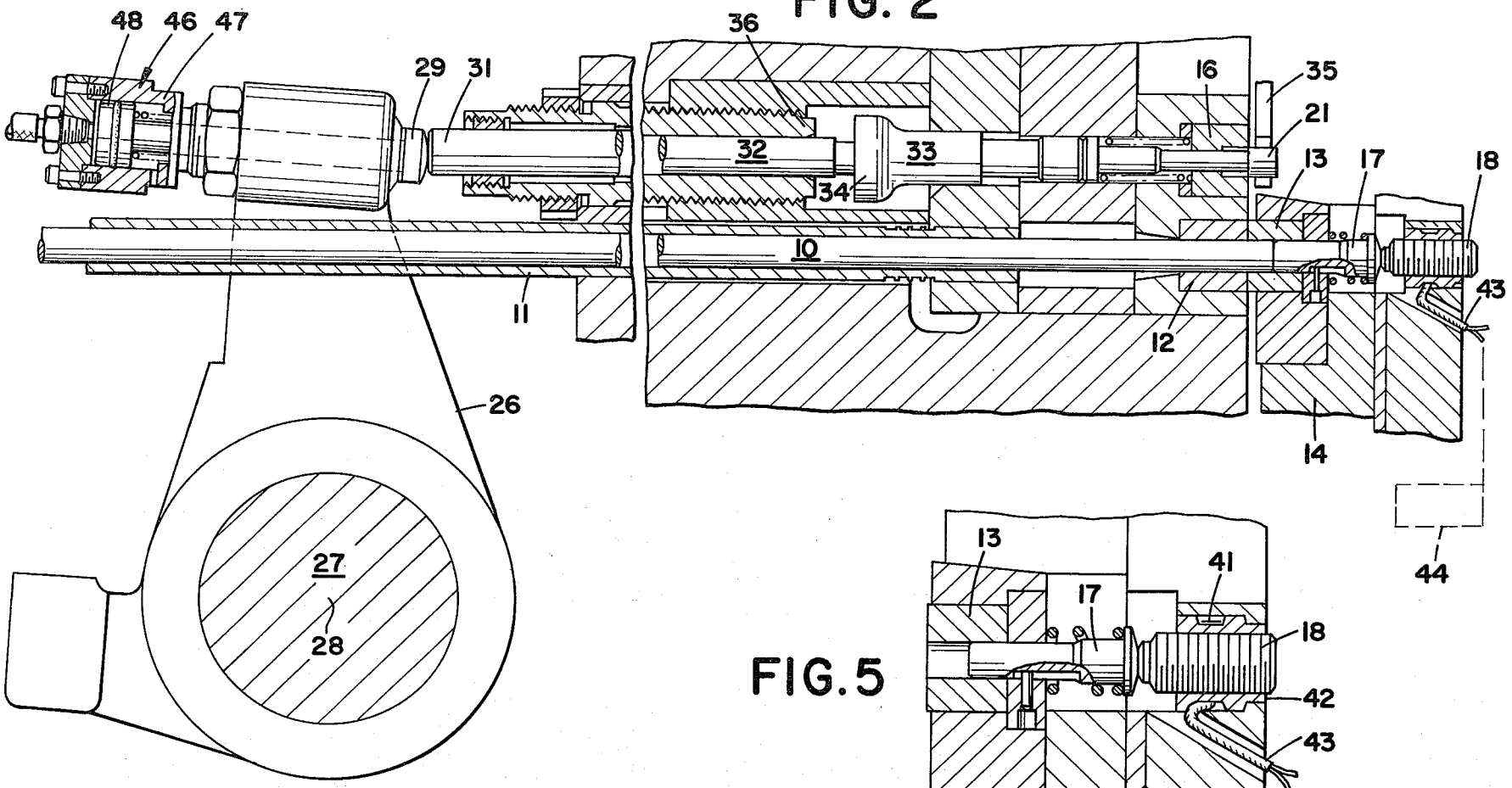
FIG. 2 is a view similar to FIG. 1, except that the components of the machine are illustrated when the shear is in alignment with the feed station and the knockout has completed a normal ejection operation.
Figure 5:
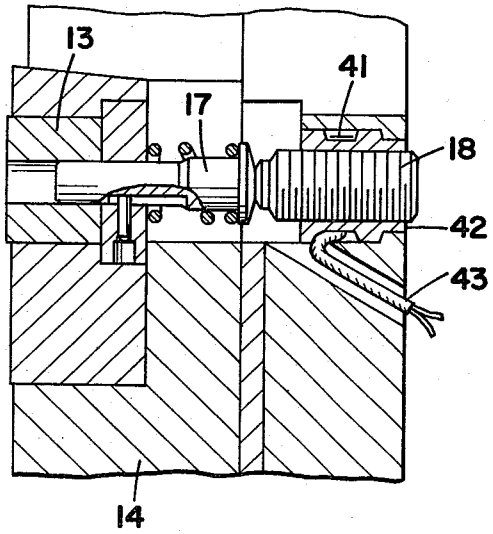
FIG. 5 is an enlarged, fragmentary section of the shear mechanism and stock gauge on which the short workpiece sensor is located.
Figure 3:
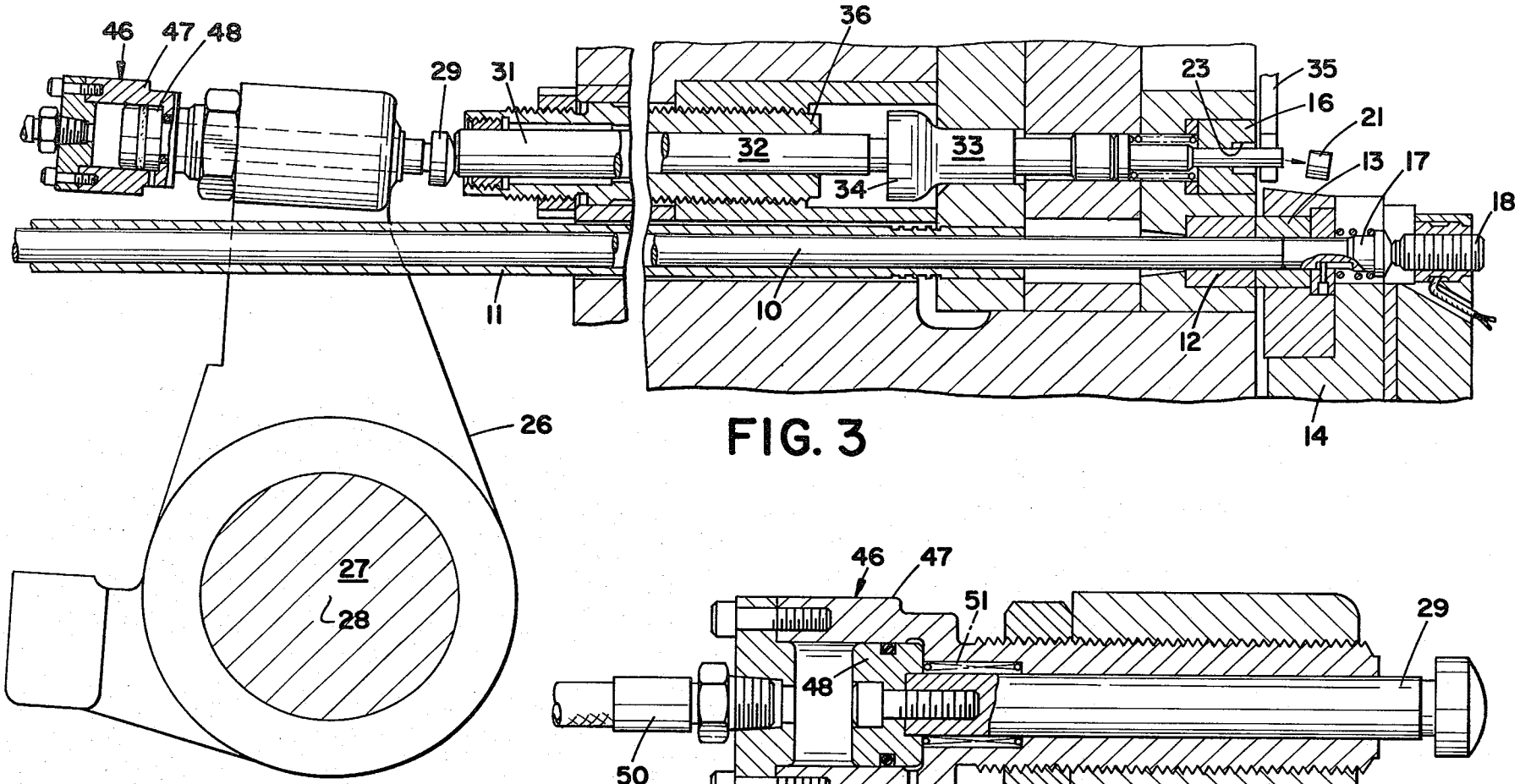
FIG. 3 is a view similar to FIG. 2, but illustrating the elements of the machine when the knockout mechanism is overstroked to push a workpiece beyond the transfer fingers for rejection.

Referring to FIGS. 1 through 3, in a machine in accordance with the present invention wire or rod stock 10 is fed axially of the machine through a feed tube 11 to the stationary quill 12 of a shear provided with a movable cutter ring 13 mounted in a vertically reciprocable cutter ring carrier 14. This shear is movable between the lowered or feed position illustrated in FIGS. 2 and 3 and a raised position illustrated in FIG. 1. In the lowered position, the cutter ring 13 is aligned with the stationary quill 12 so that stock 10 can feed into the cutter. In the raised position, the cutter ring 13 is positioned in alignment with an associated die 16, constituting part of the first work station of the machine.

While the cutter ring 13 is in the lowered position of FIGS. 2 and 3, the stock 10 is fed forward by feed rolls (not illustrated) until the forward end of the stock is seated against a slidable pin 17, the forward end of which projects into the cutter ring 13. The rearward end of the pin 17 in this position engages an adjustable screw 18 of a stock gauge assembly so that the length of the stock moved into the cutter ring 13 is accurately determined by the adjusted position of the stock gauge 18.

At the completion of the feed stroke, the cutter ring 13 is carried upward to the position of FIG. 1 and, in cooperation with the stationary quill 12, shears a workpiece 21 from the forward end of the stock and positions such workpiece in alignment with the die 16. The pin 17 is carried along with the cutter ring to a position in alignment with the die 16 and during the forward stroke of the slide of the machine, a tool 22 carried by the slide is advanced into engagement with the rearward end of the pin 17 and causes the pin 17 to be moved forward. This forward movement of the pin 17 first moves the workpiece 21 into the die 16 and, at the completion of the stroke, forms the workpiece to the shape of the cavity 23 in the first die 16, completing the first working stroke on the workpiece.

As the slide retracts, the cutter ring 13 is carried by its carrier 14 back to the lowered position of FIGS. 2 and 3 for a subsequent feeding and cutting sequence.

A knockout or ejector mechanism is provided for the first work station containing the die 16. Such mechanism includes a knockout lever 26 mounted on a pivot shaft 27 for limited oscillating rotation about a pivot axis 28 by a cam mechanism (not illustrated). Mounted on the upper end of the knockout lever 26 is a drive pin 29 which engages the rearward end of a first pin 31 of a series of pins constituting the knockout system. Such pin drives an ejector pin 32 from its rearward position illustrated in FIG. 1 when the knockout lever is rotated in a clockwise direction from the position of FIG. 1. An intermediate pin 33 engages the forward end of the knockout pin 32 and is provided with an enlarged portion 34 which engages an adjustable sleeve 36 in a working stroke so that the working or upsetting forces on the forward end of the knockout pin 32 are directly absorbed into the machine frame.

Figure 6:
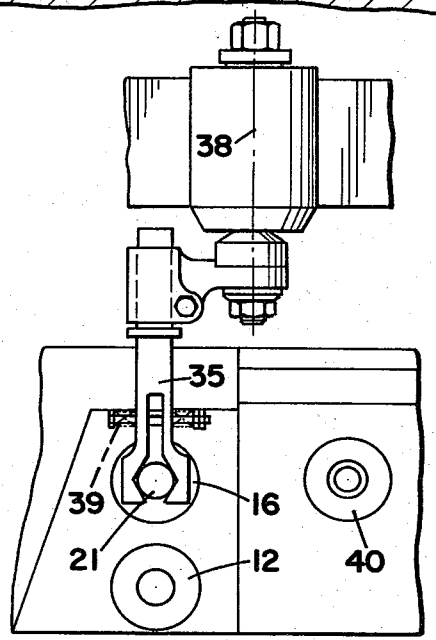
FIG. 6 is a fragmentary, vertical section illustrating the transfer for transferring properly sized workpieces between the first work station and a subsequent work station.

At the completion of the working operation in which the workpiece 21 is upset in the die cavity 23, the normal operation of the knockout is to eject the workpiece 21 from the die cavity into a pair of transfer fingers 35, as illustrated in FIG. 2. Such transfer fingers 35, which are best illustrated in FIG. 6, grip the ejected workpiece 21 as it is ejected from the die and, through a pivoted drive, transfer the workpiece to a position in front of a die 40 at the subsequent work station. At such subsequent work station, the workpiece is subsequently worked by a tool (not illustrated), also carried by the machine slide.

As illustrated in FIG. 6, the transfer fingers oscillate back and forth around a pivot axis 38 to provide the transfer movement, and the transfer fingers include opposed finger elements which are spring-biased by a spring system 39 toward the gripping position. As a workpiece is ejected from the die 16 by the knockout pin 32, fingers resiliently engage the surface of the workpiece to grip it for the transfer operation.

In accordance with the present invention, a sensor is provided in the stock gauge assembly and includes a strain gauge 41 mounted on a threaded sleeve 42 into which the stock gauge 18 is threaded. The strain gauge provides an electrical output signal through leads 43 through a control system schematically illustrated at 44, which in turn generates a signal connected to operate rejection means to reject a workpiece in the event that such workpiece is of improper size. For example, when proper feeding occurs, a substantially predetermined force is applied to the strain gauge by the engagement of the forward end of the stock with the pin 17 and, in turn, its engagement with the stock gauge adjustment screw 18. On the other hand, in the absence of proper feeding, such normal force does not occur on the stock gauge, and this lack of force sensed by the strain gauge is used to generate a signal to indicate that a short or improper length blank will now be cut during the next operation of the shear. When this occurs, the short blank is rejected so that it will not be sequentially transferred to any subsequent working station.

Figure 4:
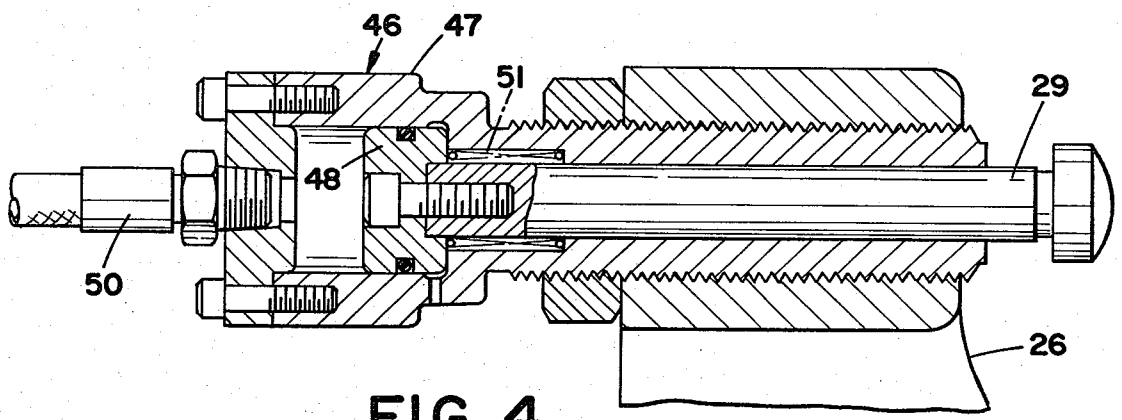
FIG. 4 is an enlarged, fragmentary section of the air cylinder structure for causing overstroking of the knockout.

Rejection is accomplished in response to the signal generated by the sensor 41 by a piston-and-cylinder actuator 46 mounted on the upper end of the arm 26. This actuator (best illustrated in FIG. 4) includes a cylinder body assembly 47 and a piston 48 which is connected to the rearward end of the member 29. When pressure is admitted through a pressure line 50 into the cylinder 47 on the back side of the piston 48, the member 29 is extended to the right, as viewed in FIG. 3, causing the knockout pin 32 to be extended beyond its normal kickout position to move the workpiece 21 through the fingers 35 (as illustrated in FIG. 3) so that it cannot be gripped by the fingers for transfer to a subsequent work station. Instead, the improperly sized workpiece 21 is dropped out of the machine and is not transferred. A spring 51, best illustrated in FIG. 4, is provided to normally maintain the piston 47, and in turn the member 29, in its retracted position, which is the position in which it remains for the normal operation for the ejection and proper transfer of properly sized workpieces. It is only when the sensor 41 esablishes that an improperly sized workpiece is in the work station associated with the sensor that fluid under pressure, preferably air pressure, is admitted through the pressure line 48 to cause the overstroke of the knockout system and rejection of the improperly sized workpiece.

With the illustrated embodiment of this invention, a simple system is provided for automatically rejecting improperly sized workpieces. The system requires merely a simple actuator mounted on the knockout lever 26 and a sensor on the stock gauge which senses the absence of a proper feed stroke of the stock 10.

It should be understood that even though the invention is illustrated in connection with the shearing and first forming station of a progressive forming machine, it is within the scope of this invention to provide for the rejection of an improperly sized workpiece at any work station within the machine. In such instance, a sensor may be provided, for example, on the tool at a given work station, and an rejection cylinder is provided on the associated knockout lever to cause overstroke of the knockout and rejection of the piece from the machine at the particular work station where the problem is sensed. In fact, in accordance with this invention, it is contemplated that sensing and rejection of a workpiece can be provided at each of a plurality of work stations. Further, the control system associated with the sensor can be arranged to provide a rejection signal if an excessive load occurs on the tool, or if the load on the tool is below the load normally encountered for proper working of the workpiece.

Although the preferred embodiment of this invention has been shown and described, it should be understood that various modifications and rearrangements of the parts may be resorted to without departing from the scope of the invention as disclose and claimed herein.

What is claimed is:

1. A machine for sequentially forging workpieces comprising a plurality of work stations at which a workpiece is sequentially forged, a transfer for gripping and transferring workpieces between said work stations wherein said transfer includes gripping fingers for engaging said workpiece and holding said workpiece therein, a sensor associated with at least one work station operable to establish that an improper workpiece is at said associated work station, an ejector at said associated work station normally operable to eject a workpiece from said associated work station into said gripping fingers for transfer to a subsequent work station, said ejector including means for operating said ejector in response to a signal from said sensor to cause an improper workpiece to be ejected from said associated work station into momentary gripping engagement with said gripping fingers and out of gripping enagement with said gripping fingers.

2. A machine for sequentially forging workpieces comprising a plurality of work stations at which a workpiece is sequentially forged, a transfer for gripping and transferring workpieces between said work stations, a sensor associated with at least one work station operable to establish that an improper workpiece is at said associated work station, an ejector at said associated work station normally operable to eject a workpiece from said associated work station into said transfer for transfer to a subsequent work station, said ejector being operable in response to a signal from said sensor to cause an improper workpiece to be ejected from said associated work station without being allowed to be gripped by said transfer, means for operating said ejector through a first predetermined stroke and and means for operating said ejector through a greater stroke in response to said signal from said sensor.

3. A machine as set forth in claim 2, wherein said sensor is a load cell.

4. A machine as set forth in claim 3, wherein said sensor includes a strain gauge operable to sense a load which is in a normal range for normal operation and which is outside said normal range when an improper workpiece is present.

5. A machine as set forth in claim 2, wherein said transfer provides resiliently biased fingers for gripping workpieces, and said ejector pushes improper workpieces through and beyond said fingers.

6. A machine as set forth in claim 2, wherein said ejector includes an actuator operable to produce said greater stroke.

7. A machine as set forth in claim 6, wherein said actuator is a piston and cylinder actuator operable by fluid under pressure.

8. A machine as set forth in claim 1, wherein said machine includes a shear operable to progressively shear workpieces from the end of a piece of stock, and said sensor determines when said stock is in improper position in said shear.

9. A forging machine for sequentially cutting workpieces from elongated lengths of stock and forming said workpieces comprising a shear operable to cut workpieces from elongated lengths of stock, a first station receiving workpieces from said shear, a transfer having gripper fingers for gripping workpieces ejected from said first work station and for transferring said workpieces to a subsequent work station, an ejector operable to eject workpieces from said first station into a first position in which it is gripped by said transfer fingers, and a sensor operable to determine if a workpiece is of improper size, said ejector including means operable in response to a determination from said sensor of improper size to eject the improper-sized workpiece to a second position spaced from said first position where said transfer fingers cannot grip said blank so that it is not transferred through a subsequent station.

10. A forging machine as set forth in claim 9, wherein said shear includes a stock gauge and said sensor is mounted on said stock gauge, said sensor operating to determine when a piece of stock does not properly engage said stock gauge.

11. A forging machine as set forth in claim 10, wherein said sensor is a strain gauge.

12. A forging machine comprising a frame, a slide reciprocable on said frame, tools and dies on said slide and frame cooperating to provide a plurality of work stations for sequentially processing a workpiece, a transfer operable to sequentially transfer workpieces from one work station to the next, said transfer including transfer fingers to grip workpieces while they are being transferred, an ejector associated with at least some of said work stations operable to eject workpieces therefrom by a first stroke of ejection into the associated transfer fingers, and a sensor operable to establish when a workpiece of improper size is located in a work station, an ejector associated with said sensor including means operable to provide overstroke of ejection greater than said first stroke of ejection to move the improper-sized workpiece through the associated fingers to reject it in response to a determination by the sensor that the workpiece is of improper size.

13. A forging machine as set forth in claim 12, wherein said sensor is a load sensor operable to determine when an abnormal load is present.

* * * * *